US007832332B2

(12) United States Patent
Sato

(10) Patent No.: US 7,832,332 B2
(45) Date of Patent: Nov. 16, 2010

(54) PRINTING DEVICE AND ULTRAVIOLET IRRADIATION APPARATUS

(75) Inventor: Mitsuo Sato, Miyagi (JP)

(73) Assignee: Tohoku Ricoh Co., Ltd, Shibata-gun (JP)

( * ) Notice: Subject to any disclaimer, the term of this patent is extended or adjusted under 35 U.S.C. 154(b) by 630 days.

(21) Appl. No.: 11/349,152

(22) Filed: Feb. 8, 2006

(65) Prior Publication Data

US 2006/0219106 A1 Oct. 5, 2006

(30) Foreign Application Priority Data

Apr. 1, 2005 (JP) ..... 2005-106207

(51) Int. Cl.
*B41L 13/00* (2006.01)
*B41L 13/04* (2006.01)

(52) U.S. Cl. ..... 101/119; 101/116; 101/120

(58) Field of Classification Search ..... 101/119, 101/120, 129, 116
See application file for complete search history.

(56) References Cited

U.S. PATENT DOCUMENTS 5,247,882 A * 9/1993 Zook et al. ..... 101/120
5,517,913 A * 5/1996 Oshio et al. ..... 101/119
6,263,296 B1 * 7/2001 Nakamura ..... 702/137
6,502,506 B2 * 1/2003 Endo et al. ..... 101/118
6,782,815 B2 * 8/2004 Massolt et al. ..... 101/216
2005/0211115 A1 * 9/2005 Nakamura et al. ..... 101/116

FOREIGN PATENT DOCUMENTS

JP 4-35188 8/1992
JP 5-64878 3/1993

* cited by examiner

*Primary Examiner*—Ren Yan
*Assistant Examiner*—Leo T Hinze
(74) *Attorney, Agent, or Firm*—Oblon, Spivak, McClelland, Maier & Neustadt, L.L.P.

(57) ABSTRACT

A printing device comprising a stencil printing device which is excellent in operativity, in which a print drum with UV ink and non-UV ink can be used in a single stencil printing device. The printing device has a stencil printing control device and UV irradiation control device in which a drum unit ink type identifying sensor, which detects whether the print drum attached to the stencil printing device main body is a print drum unit for UV ink or a drum unit for non-UV ink, is used to operate at least a UV lamp, of the UV lamp and a UV auxiliary lamp, and to irradiate UV light when attachment of the drum unit for UV ink is detected, or to stop the operation of the UV lamp and UV auxiliary lamp when attachment of the print drum unit for non-UV ink is detected.

22 Claims, 10 Drawing Sheets

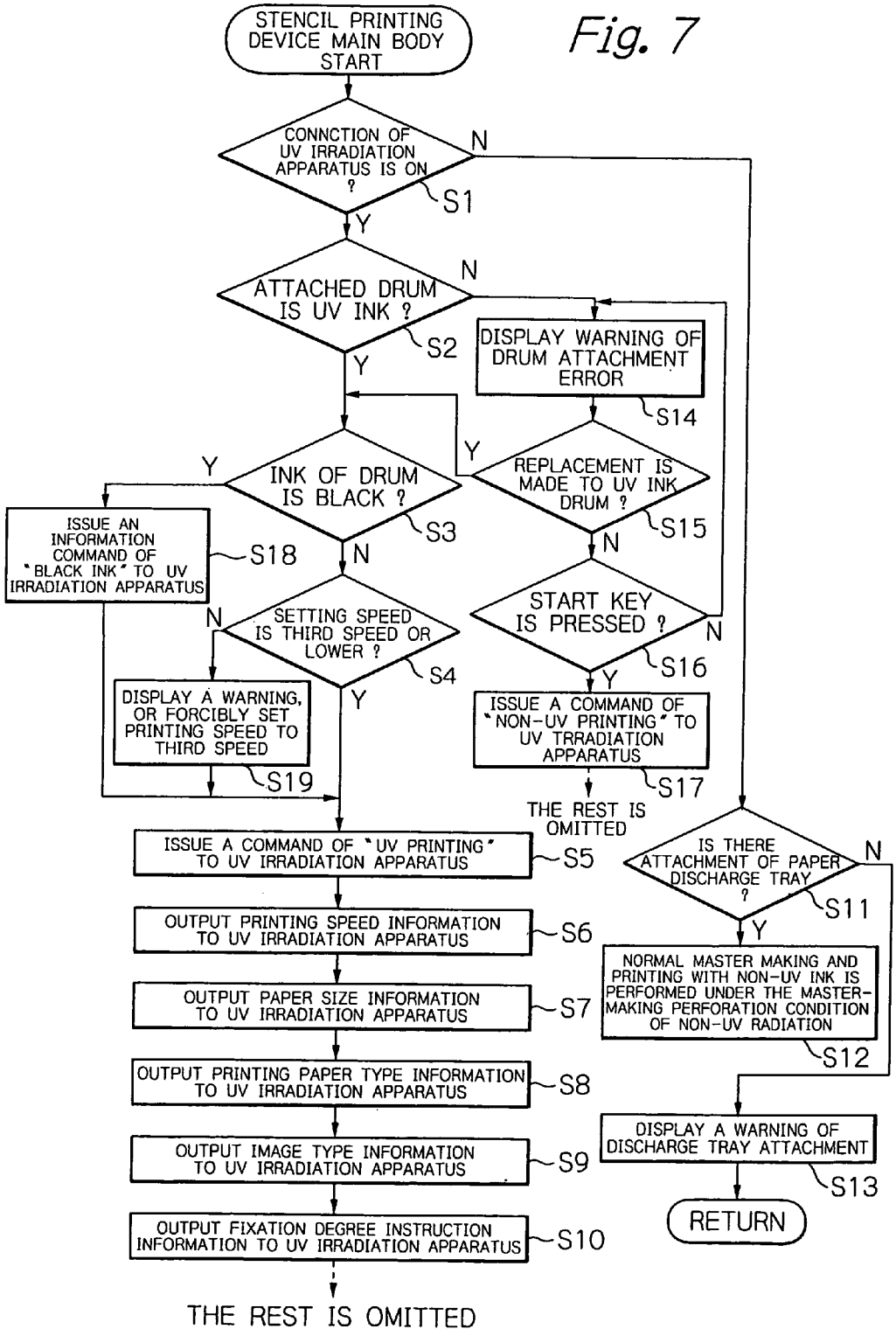
Fig. 7
STENCIL PRINTING DEVICE MAIN BODY START
CONNCTION OF UV IRRADIATION APPARATUS IS ON ?
S1
N
Y
ATTACHED DRUM IS UV INK ?
S2
N
Y
DISPLAY WARNING OF DRUM ATTACHMENT ERROR
S14
INK OF DRUM IS BLACK ?
S3
Y
N
REPLACEMENT IS MADE TO UV INK DRUM ?
S15
Y
N
ISSUE AN INFORMATION COMMAND OF "BLACK INK" TO UV IRRADIATION APPARATUS
S18
SETTING SPEED IS THIRD SPEED OR LOWER ?
S4
N
Y
START KEY IS PRESSED ?
S16
N
Y
DISPLAY A WARNING, OR FORCIBLY SET PRINTING SPEED TO THIRD SPEED
S19
ISSUE A COMMAND OF "NON-UV PRINTING" TO UV TRRADIATION APPARATUS
S17
THE REST IS OMITTED
ISSUE A COMMAND OF "UV PRINTING" TO UV IRRADIATION APPARATUS
S5
IS THERE ATTACHMENT OF PAPER DISCHARGE TRAY ?
S11
N
Y
OUTPUT PRINTING SPEED INFORMATION TO UV IRRADIATION APPARATUS
S6
NORMAL MASTER MAKING AND PRINTING WITH NON-UV INK IS PERFORMED UNDER THE MASTER-MAKING PERFORATION CONDITION OF NON-UV RADIATION
S12
OUTPUT PAPER SIZE INFORMATION TO UV IRRADIATION APPARATUS
S7
OUTPUT PRINTING PAPER TYPE INFORMATION TO UV IRRADIATION APPARATUS
S8
DISPLAY A WARNING OF DISCHARGE TRAY ATTACHMENT
S13
OUTPUT IMAGE TYPE INFORMATION TO UV IRRADIATION APPARATUS
S9
RETURN
OUTPUT FIXATION DEGREE INSTRUCTION INFORMATION TO UV IRRADIATION APPARATUS
S10
THE REST IS OMITTED

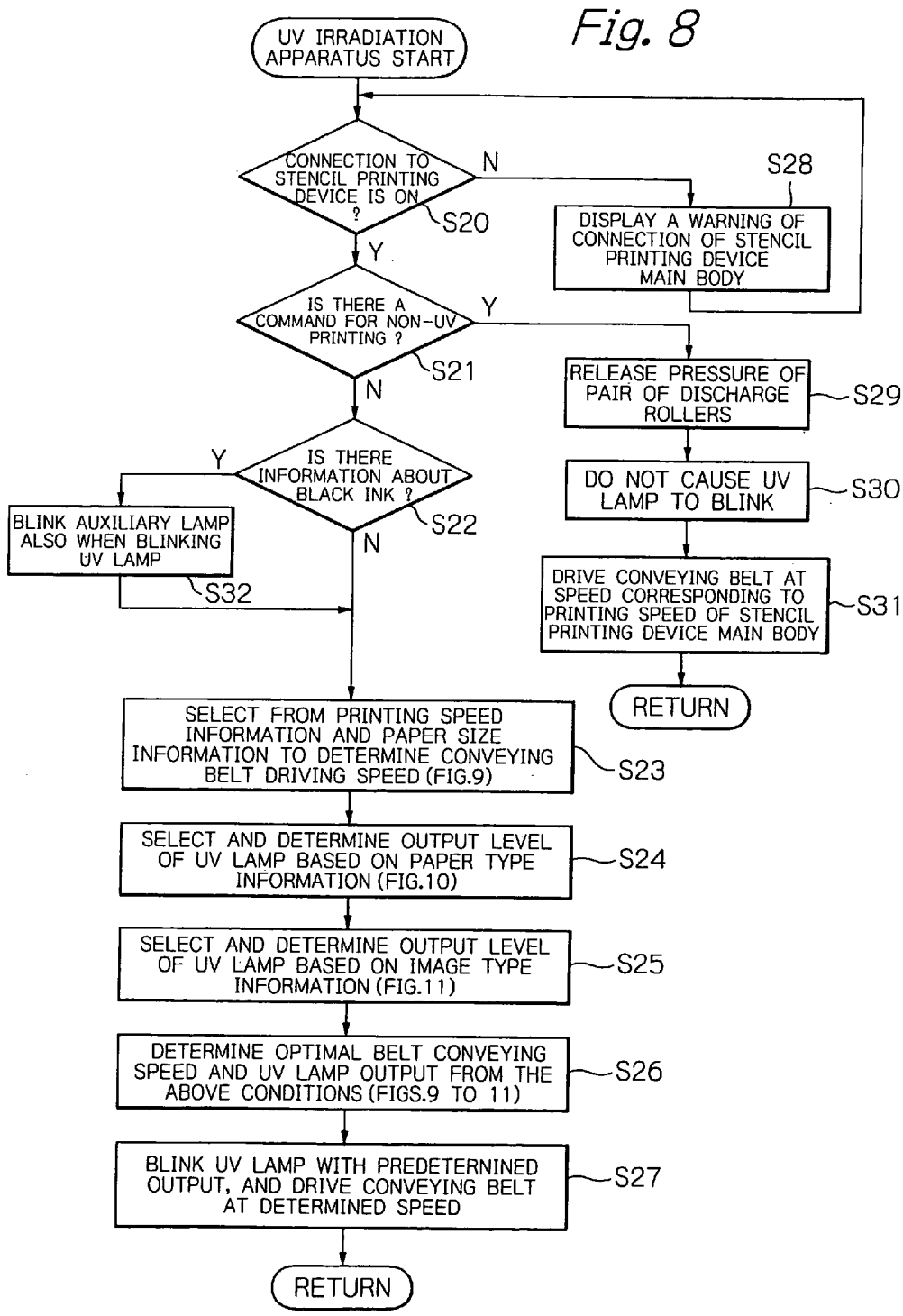
Fig. 8
UV IRRADIATION APPARATUS START
CONNECTION TO STENCIL PRINTING DEVICE IS ON ?
S20
N
S28
DISPLAY A WARNING OF CONNECTION OF STENCIL PRINTING DEVICE MAIN BODY
Y
IS THERE A COMMAND FOR NON-UV PRINTING ?
S21
Y
RELEASE PRESSURE OF PAIR OF DISCHARGE ROLLERS
S29
N
IS THERE INFORMATION ABOUT BLACK INK ?
S22
Y
BLINK AUXILIARY LAMP ALSO WHEN BLINKING UV LAMP
S32
N
DO NOT CAUSE UV LAMP TO BLINK
S30
DRIVE CONVEYING BELT AT SPEED CORRESPONDING TO PRINTING SPEED OF STENCIL PRINTING DEVICE MAIN BODY
S31
RETURN
SELECT FROM PRINTING SPEED INFORMATION AND PAPER SIZE INFORMATION TO DETERMINE CONVEYING BELT DRIVING SPEED (FIG.9)
S23
SELECT AND DETERMINE OUTPUT LEVEL OF UV LAMP BASED ON PAPER TYPE INFORMATION (FIG.10)
S24
SELECT AND DETERMINE OUTPUT LEVEL OF UV LAMP BASED ON IMAGE TYPE INFORMATION (FIG.11)
S25
DETERMINE OPTIMAL BELT CONVEYING SPEED AND UV LAMP OUTPUT FROM THE ABOVE CONDITIONS (FIGS.9 TO 11)
S26
BLINK UV LAMP WITH PREDETERNINED OUTPUT, AND DRIVE CONVEYING BELT AT DETERMINED SPEED
S27
RETURN

Fig. 9

[cm/sec]

| PAPER SIZE \ PRINTING SPEED | FIRST SPEED | SECOND SPEED | THIRD SPEED (FOUTH, FIFTH SPEEDS) |
|---|---|---|---|
| A3 LONGITUDINAL DIRECTION FEEDING | 50 | 65 | 80 |
| B4 LONGITUDINAL DIRECTION FEEDING | 42 | 54 | 67 |
| A4 LONGITUDINAL DIRECTION FEEDING | 34 | 43 | 54 |
| A4 WIDTH DIRECTION FEEDING (B5 LONGITUDINAL DIRECTION FEEDING) | 25 | 32 | 40 |

Fig. 10

| PAPER TYPE | UV LAMP OUTPUT |
|---|---|
| PLAIN PAPER | SET LAMP OUTPUT TO "NORMAL" |
| POST CARD | SET LAMP OUTPUT TO "NORMAL×1.2" |
| COATED PAPER | SET LAMP OUTPUT TO "NORMAL×1.3" |

Fig. 11

| IMAGE TYPE | UV LAMP OUTPUT |
|---|---|
| SOLID IMAGE OR PHOTOGRAPH | SET LAMP OUTPUT TO "NORMAL" |
| IMAGE WITH CHARACTERS | SET LAMP OUTPUT TO "NORMAL×0.8" |

PRINTING DEVICE AND ULTRAVIOLET IRRADIATION APPARATUS

BACKGROUND OF THE INVENTION

1. Field of the Invention

The present invention relates to a printing device, and particularly to a printing device comprising a stencil printing device for performing stencil printing using a UV curable ink, and to an ultraviolet irradiation apparatus connected to a paper discharge opening of the printing device and performing ultraviolet irradiation onto a discharged printed matter, including a stencil-printed matter.

2. Description of the Related Art

A stencil printer (referred to as "stencil printing device" hereinafter" is widely used for printing various distributed papers and documents in educational markets, public offices, partnership organizations, hospitals and the like, and for obtaining a number of printed matters or a number of copies of printed matters such as newspaper inserts, classifieds, messages inside private companies, because the stencil printing device is capable of printing at high speeds at low running cost. The printing ink employed here is the one which normally is not solidified in the atmosphere, and troubles such as cleaning the print drum portion every time the printing device is used can be eliminated so that anyone can easily operate the printing device anytime. Since the stencil ink is designed such that it penetrates a piece of printing paper (an example of a sheet-like recording medium; referred to as "paper" hereinafter) and is supposedly dried, the surface of the printed matter easily becomes messy if rubbed by hand due to the undried ink. This fact has been pointed out as a significant problem of the stencil-printing device from the past, but no effective countermeasures have been implemented.

As a conventional printing device for improving the drying performance of printed matters, for example, Publication of Examined Utility Model Application No. H4-35188, Japanese Patent Application Laid-Open No. H5-64878 and the like proposes a stencil printing device designed for UV curable ink, which comprises an ultraviolet (abbreviated as "UV" hereinafter) irradiation apparatus and performs stencil printing using a UV curable ink.

However, the stencil-printing device disclosed in the abovementioned Examined Utility Model Application Publication No. H4-35188 is a stencil-printing device designed for UV curable ink, in which only a UV curable ink (referred to as "UV ink" hereinafter) can be used, thus, if printing with non-UV ink was necessary, another stencil printing device designed for non-UV ink was required. On the other hand, the printing device disclosed in the abovementioned Japanese Patent Application Laid-Open No. H5-64878 can perform printing with normal inks, but the paper conveying means has to be removed, and operations/performances on the device were extremely troublesome.

SUMMARY OF THE INVENTION

An object of the present invention, therefore, is to provide a printing device comprising a stencil-printing device which is excellent in operativity, in which a print drum installed with UV ink and non-UV ink can be used in a single stencil-printing device.

A printing device of the present invention comprises an ultraviolet irradiation device for irradiating a printed paper with ultraviolet radiation; an attaching/detaching device for selectively attaching and detaching to and from a printing device main body a print drum for ultraviolet curable ink, installed with an ultraviolet curable ink, and a print drum for non-ultraviolet curable ink, installed with a non-ultraviolet curable ink; a print drum detection device for detecting whether the print drum attached to the printing device main body via the attaching/detaching device is either the print drum for ultraviolet curable ink or the print drum for non-ultraviolet curable ink; and a first control device for operating the ultraviolet irradiation device when attachment of the print drum for ultraviolet curable ink is detected by the print drum detection device and stopping the operation of the ultraviolet irradiation device when attachment of the print drum for non-ultraviolet curable ink is detected by the print drum detection device.

An ultraviolet irradiation apparatus of the present invention is capable of being connected to the printing device and comprises an ultraviolet irradiation device for irradiating a printed paper with ultraviolet radiation; a paper conveying device for conveying the printed paper to be irradiated with the ultraviolet radiation; and a control device for operating the ultraviolet irradiation device on the basis of a signal transmitted from the printing device indicating that a print drum for ultraviolet curable ink installed with an ultraviolet curable ink has been attached, and for stopping the operation of the ultraviolet irradiation device on the basis of a signal transmitted from the printing device indicating that a print drum for non-ultraviolet curable ink installed with a non-ultraviolet curable ink has been attached.

BRIEF DESCRIPTION OF THE DRAWINGS

The above and other objects, features and advantages of the present invention will become more apparent from the following detailed description taken with the accompanying drawings in which:

FIG. 7 is a flowchart showing a sequence operation of the stencil printing device main body;

FIG. 8 is a flowchart showing a sequence operation of the UV irradiation apparatus;

FIG. 9 is a figure showing the paper conveying speed of a paper conveying belt and a pair of discharge rollers with respect to the relationship between printing speed information and paper size information;

FIG. 10 is a figure showing a UV lamp output corresponding to the type of paper; and FIG. 11 is a figure showing a UV lamp output corresponding to the type of an image.

DESCRIPTION OF THE PREFERRED EMBODIMENTS

Figure 1:
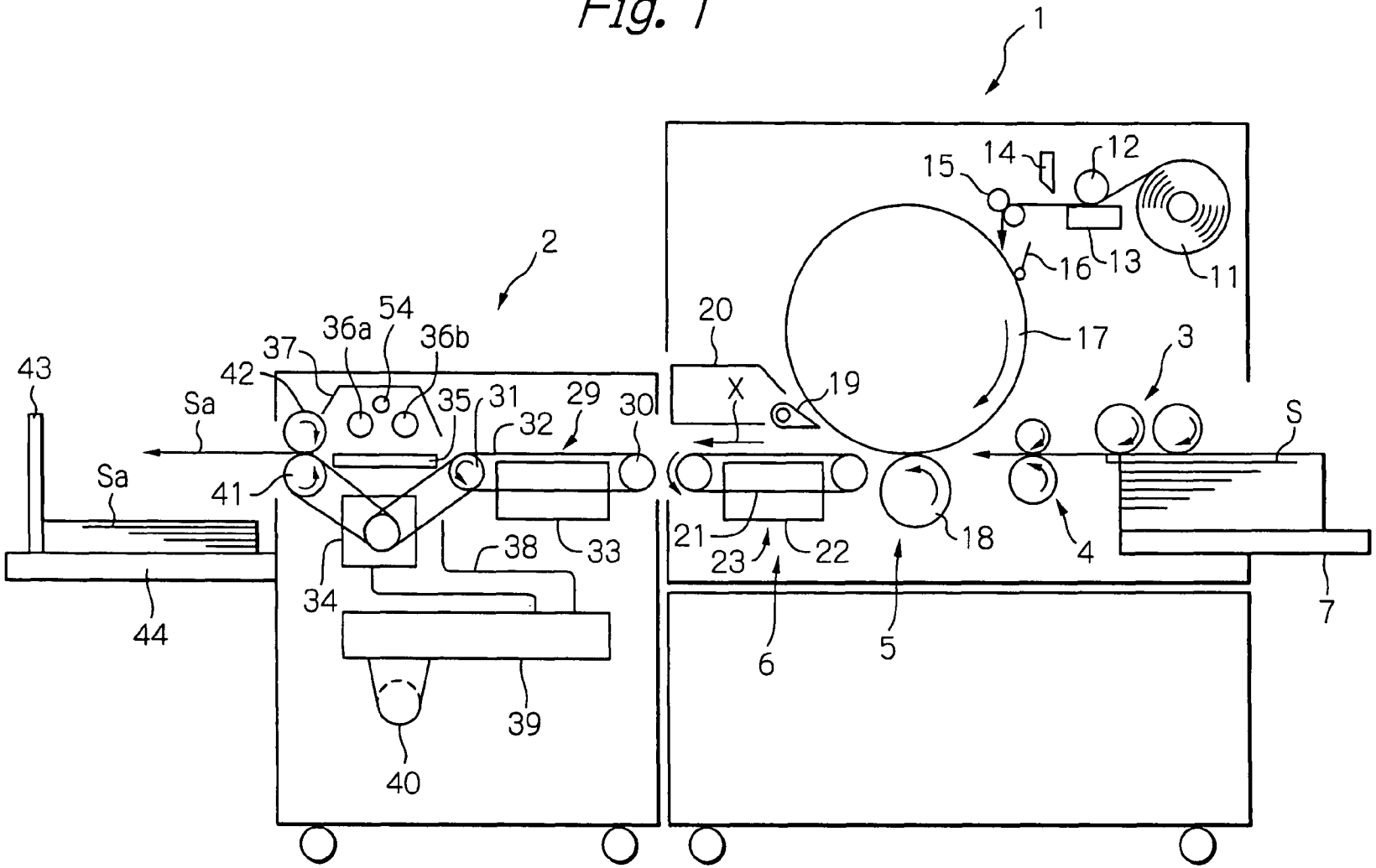
FIG. 1 is a schematic front view of a stencil-printing device showing an embodiment of the present invention.

Hereinafter, each embodiment as the best mode to implement the present invention, and a modification of the embodiment are described with reference to the drawings. It should be noted that like reference characters are used for the members, components, and the like to indicate the same functions, forms and the like throughout the embodiments and modifications, thus the overlapping explanations are simplified or omitted accordingly. In order to simplify the drawings and explanations thereof, those components which should be indicated in the drawings may be omitted accordingly unless special explanations are required for such drawings. In the case of providing explanations by quoting the components described in the publication of unexamined patent applications and the like as is, parentheses are used to indicate the components, thus these components are distinguished from those components used in each of the embodiments.

First, FIG. 1 is referred to explain the entire configuration of the stencil-printing device as an example of the printing device related to an embodiment of the present invention. The entire configuration of the stencil-printing device is well known to those skilled in the art, thus it is explained briefly along with the operation thereof.

In the figure, the numeral 1 indicates the stencil printing device main body as the printing device main body, and the numeral 2 indicates a UV irradiation apparatus. The stencil-printing device is configured such that the stencil printing device main body 1 and the UV irradiation apparatus 2 are mechanically and electrically connected to each other. A UV irradiation apparatus connection detection sensor 50, which acts as connection detection means for detecting whether or not the UV irradiation apparatus 2 is connected mechanically and electrically to the stencil printing device main body 1, is disposed in the stencil printing device 1, the UV irradiation apparatus connection detection sensor 50 being shown only in FIG. 4.

Figure 4:
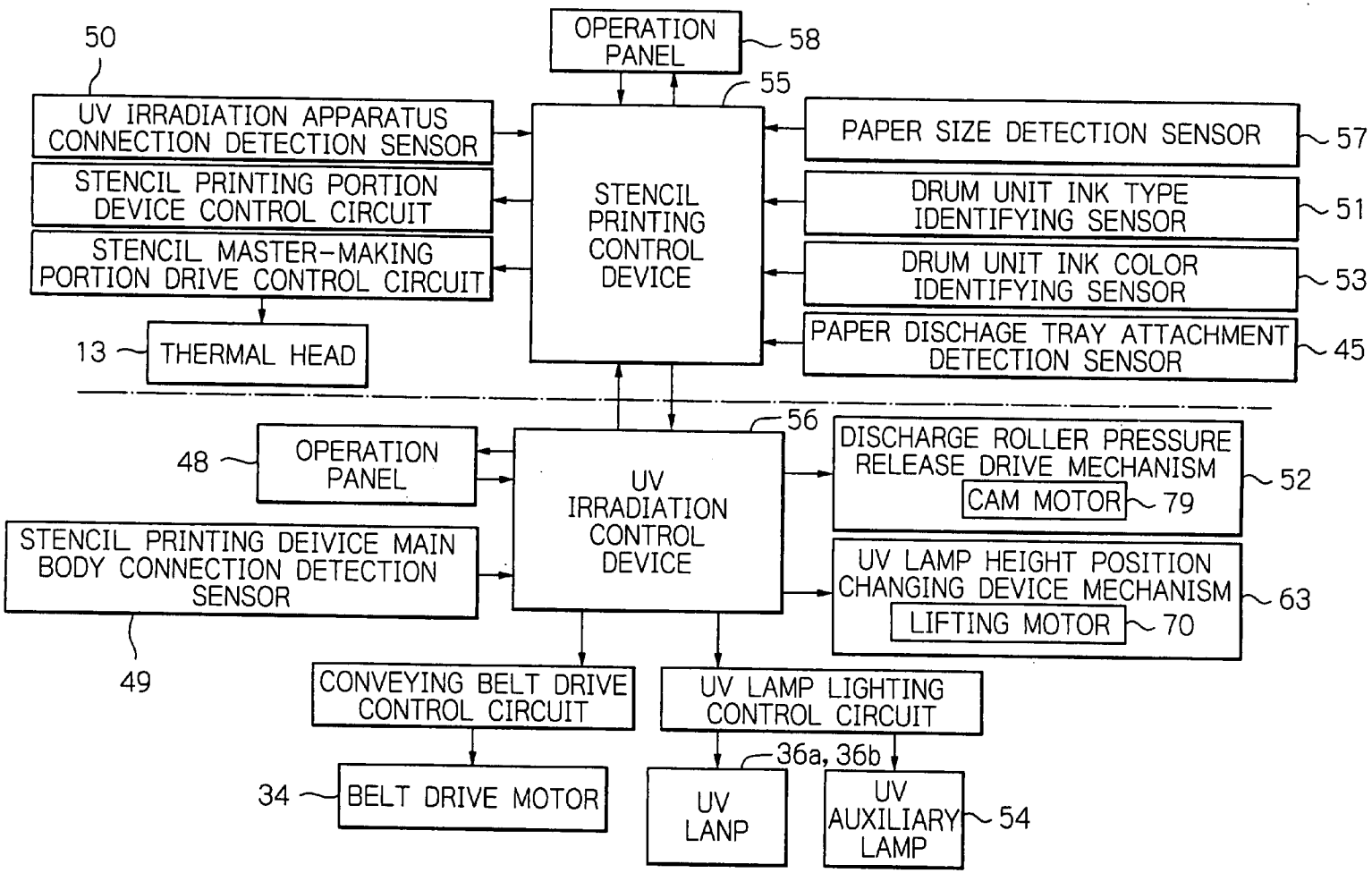
FIG. 4 is a block diagram showing a control configuration of the stencil printing main body and UV irradiation apparatus of the stencil-printing device.

As a specific example of the UV irradiation apparatus connection detection sensor 50, it is configured such that, when a UV irradiation control device 56 is communicably connected to a stencil printing control device 55 shown in FIG. 4 via an unshown communication cable, the stencil printing control device 55 recognizes/judges the connection. Further, as shown in FIG. 4 only, a stencil printing device main body connection detection sensor 49, which acts as connection detection means for detecting whether or not the stencil printing device main body 1 is connected mechanically and electrically to the UV irradiation apparatus 2, may be disposed in the UV irradiation apparatus 2. As a specific example of the stencil printing device main body connection detection sensor 49, it is configured such that, when the stencil printing control device 55 is connected to the UV irradiation control device 56 via the communication cable, the UV irradiation control device 56 recognizes/judges the connection.

The stencil printing device main body 1 comprises a first paper feeding portion 3 which separates papers S on a paper feed tray 7 one by one and sends the papers, a second paper feeding portion 4 which sends one of the sent papers S to a stencil printing portion 5 at predetermined timing, the stencil printing portion 5 which performs stencil printing on the papers S sent at the predetermined timing, and a paper discharge portion 6 which discharges and conveys the papers S on each of which a printed image is formed by the stencil printing.

The first paper feeding portion 3 comprises a paper feed roller which sends the upper most paper S stacked on the paper feed tray 7, and a split cover and split member which split the sent papers S one by one and sends the papers S to the second paper feeding portion 4. The second paper-feeding portion 4 comprises a top and bottom pair of resist rollers.

The paper feed tray 7 is disposed with a paper size detection sensor 57 which acts as paper detection means for detecting the paper size including the conveyance direction size of each of the papers S stacked on the paper feed tray 7, the paper size detection sensor 57 being shown only in FIG. 4. As a specific example of the paper size detection sensor 57, the device which is same as the paper size detection sensor (117) of the paper size detection means (109) horizontal size detection sensor (118*a*, 118*b*) and vertical size detection sensor (119*a*, 119*b*, 119*c*), which is described in the paragraphs [0.0122] through [0125] and shown in FIG. 11 of Japanese Patent Application Laid-Open No. 2003-312914, is employed. The stencil printing device main body 1 is of the front-loading type in which a user can perform various operations, facing an operation panel, which is described hereinafter, and the paper feed tray 7 as shown in FIG. 1, and in which the paper size (vertical length×horizontal length) can be determined from the vertical size of the paper S, which is the length perpendicular to and facing a paper conveyance direction X, and the horizontal size (conveyance direction size) of the paper S, which is the length parallel to the paper conveyance direction X.

The stencil printing portion 5 comprises: a print drum 17, which has a master clamper 16 clamping/holding a leading end portion of a processed master 11 and freely opened and closed, and which is freely rotated, with the processed master 11 wrapped around an external surface of the print drum 17; and a press roller 18 which acts as pressing means for pressing the papers S, which are sent from the second paper feeding portion 4, against the print drum 17. The print drum 17 is rotary driven by a main motor which is not shown.

The paper discharge portion 6 comprises: a split nail 19 and air-knife fan 20, which are slidable and separate the paper S which is subjected to stencil printing from the processed master 11 on the print drum 17; and a belt drawing and conveying portion 23, which has an endless paper conveying belt 21 which is wrapped around each roller located on an upstream side and downstream side of the paper conveyance direction X (paper discharge direction X), and formed with a plurality of holes, and a suction fan 22 which draws the printed paper S onto the paper conveying belt 21.

The upper right side of the stencil printing portion 5 is disposed with a stencil master-making portion, which performs stencil master-making while drawing the master 11 from a master storage portion, which stores a rolled long stencil base paper 11 (referred to as "master 11" hereinafter) such that it can let the master 11 out. In this stencil master-making portion, on the basis of a start signal sent from a master-making start key 68A disposed on an operation panel 58 shown in FIG. 2, master-making/master-loading operation is started after or partially in parallel with separation/master-removal of a used master from the print drum 17, the used master being used in a previous printing in a master-removing device, which is not shown.

The master 11 is drawn from the master storage portion by means of the platen roller 12 and pressed against a thermal head 13 while being conveyed, whereby numbers of electric heating element (not shown) of the thermal head 13 are selectively caused to generate heat, and perforation processing is performed on the master 11. The processed master 11 is trimmed by a cutter 14, supplied by a pair of conveying rollers 15, which are located downstream of the conveyance direction, to the master damper 16 provided on the external surface of the print drum 17, and clamped by the master clamper 16. In this manner the processed master 11 is wrapped around and attached to the external surface of the print drum 17 by the rotation of the print drum 17 in a direction of an arrow shown in the figure.

Once the paper S is fed to the stencil printing portion 5 by the operations of the first paper feeding portion 3 and the second paper feeding portion 4, the press roller 18 presses the paper S against the print drum 17 attached with the processed master 11, whereby an ink which has passed through a perforated portion of the processed master 11 is transferred onto the paper S, thereby forming a predetermined stencil printed image.

The print drum 17 configures a drum unit which is integrated with an ink container or ink feed pump which are not shown, and is detachable with respect to the stencil printing device main body 1 by a simple operation. A print drum unit for UV ink comprising a print drum for UV curable ink installed with a UV curable ink (referred to as "print drum for UV ink" hereinafter), and a print drum unit for non-UV ink comprising a print drum for non-UV curable ink installed with a normal non-UV curable ink (referred to as "print drum for non-UV ink" hereinafter) are set separately, and are both configured so as to be detachable with respect to the stencil printing device main body 1 by means of the attaching/detaching means. As a specific example of the detachable means or detachable mechanism (not shown) used for selectively detaching the print drum unit for UV ink and the print drum unit for non-UV ink with respect to the stencil printing device main body 1, the one which is same as, for example, the printing cylinder supporting unit shown in FIG. 1 through FIG. 4 of Laid-Open Japanese Utility Model Publication No. S61-85462 is employed. Alternatively, it is possible to employ the one which is same as the device comprising the holding means (36), griping frame (50), front frame (51), rear frame (52) and the like shown in FIG. 2, FIG. 3 and the like and described in the paragraph [0021] and the like in Japanese Patent Application Laid-Open No. H5-229243.

In the stencil printing device main body 1 in the vicinity of the attaching/detaching means, a drum unit ink type identifying sensor 51, which acts as detection means for detecting either the print drum unit for UV ink or the print drum unit for non-UV ink attached to the attaching/detaching means, is disposed, the drum unit ink type identifying sensor 51 being shown in FIG. 4 only. A specific example employed as the drum unit ink type identifying sensor 51 is the one in which combinations of the connection between, for example, an electric connector (for example, male) disposed in the print drum unit and an electric connector (for example, female) disposed in the stencil printing device main body 1 are used so that the stencil printing control device 55 can electrically detect and judge the difference of the combinations.

Moreover, in the stencil printing device main body 1 in the vicinity of the attaching/detaching means, a drum unit ink color identifying sensor 53, which acts as ink color detection means for detecting whether the color of ink in the print drum unit for UV ink attached to the stencil printing device main body 1 via the attaching/detaching means is black or other color, is disposed, the drum unit ink color identifying sensor 53 being shown in FIG. 4 only. A specific example employed as the drum unit ink color identifying sensor 53 is, for example, the one which detects a color of ink inside the print drum unit by means of a combination of the Hall element sensor group (20) and each magnet (30, 31, 32) shown in FIG. 3 and the like and described in the paragraphs [0053] through [0054] in Japanese Patent Application Laid-Open No. H8-132723.

The reason for employing such devices is as follows: in the case of a black ink, carbon as a pigment of this color absorbs UV (ultraviolet) radiation, causing disturbance in passage of UV light, whereby a UV ink is not cured sufficiently by UV radiation from a UV lamp, thus radiation which is stronger than that in the case of using other color inks is required.

The printed paper S which is subjected to stencil printing is forcibly ripped from the external surface of the print drum 17 by the split nail 19 and air-knife fan 20 in the paper discharge portion 6, and conveyed to the downstream side of the paper conveyance direction X while being drawn toward a surface of the paper conveying belt 21, which is rotary driven by the unshown motor by means of the suction fan 22 configuring the belt drawing and conveying portion 23.

As in the prior art, the print drum 17 is driven by the unshown main motor, the first and second paper feeding portions 3, 4 are driven respectively by, for example, a paper feed motor or a resist motor configured with a stepping motor disposed independently or through unshown drive communication means, and the paper conveying belt 21 of the belt drawing and conveying portion 23 is driven by the motor in accordance with the set printing speed which is set by means of printing speed switching keys 59*a*, 59*b* disposed on the operation panel 58, the printing speed switching keys 59*a*, 59 being described hereinafter.

On the downstream side of the paper conveyance direction X in the belt drawing and conveying portion 23, there is disposed a paper discharge tray attachment detection sensor 45, which detects whether or not a paper discharge tray 44 is connected to the predetermined position of the stencil printing device main body 1. As the paper discharge tray attachment detection sensor 45, for example, a transmission-type photosensor or a switch that electrically detects attachment of the paper discharge tray is employed.

Figure 2:
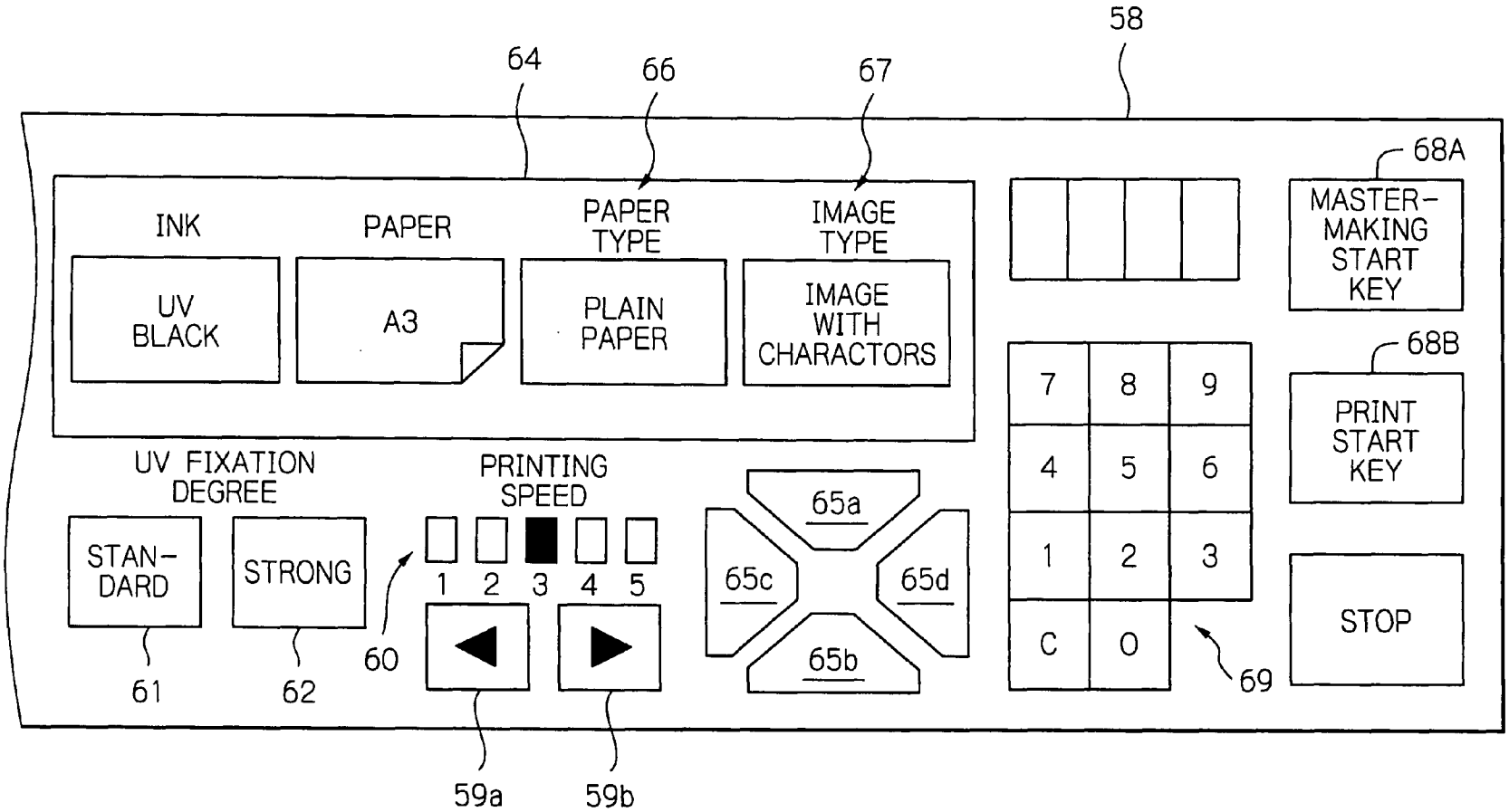
FIG. 2 is a plan view showing a substantial part of an operation panel in the stencil-printing device.

In the stencil printing device main body 1, there are disposed a draft reading device for reading an image on a draft by means of a scanning optical system (scanner), a master-removing device (not shown) which splits and removes a used master from the print drum 17, and the operation panel 58 which is described hereinafter with reference to FIG. 2, but these explanations are omitted for simplification.

Next, the configuration of the UV irradiation apparatus 2 is described in detail with reference to FIG. 1, FIG. 3, and FIG. 4, and the control configuration thereof is described along with the control configuration of the stencil printing device main body 1.

The UV irradiation apparatus 2 main comprises: a belt drawing and conveying portion 29 which conveys the printed paper S conveyed from the stencil printing device main body 1 to an ultraviolet irradiation portion which is described hereinafter; UV irradiation means having a front and back pair of U lamps 36*a*, 36*b*, a UV auxiliary lamp 54, a lamp housing 37, and the like and for irradiating the printed paper S conveyed from the belt drawing and conveying portion 29 by means of UV (ultraviolet) light; a UV lamp height position changing drive mechanism 63 for changing the UV radiation energy received by the printed paper S by changing the height which is the space between the printed paper S, and the UV lamp 36*a*, 36*b* and the UV auxiliary lamp 54; a metal guide plate 35 which is disposed in the vicinity of the downstream side of the paper conveyance direction X in the belt drawing and conveying portion 29 and acts as guiding means for guiding the printed paper S to the UV irradiation means; a upper and lower pair of discharge rollers, a lower discharge roller 41 and an upper discharge roller 42 (sometimes referred to as "pair of discharge rollers 41, 42" hereinafter), which are disposed in the vicinity of the downstream side of the paper conveyance direction X in the metal guide plate 35, act as paper conveying means for conveying an image-fixed paper Sa irradiated with UV radiation, and freely detachable with respect to each other; a belt drive motor 34 which acts as paper conveyance driving means for driving the pair of discharge rollers 41, 42; a discharge roller pressure release drive mechanism 52 for releasing a pressure-welded state between the lower discharge roller 41 and the upper discharge roller 42; and a paper discharge tray 44 which acts as a paper discharge base having an end fence 43 for adjusting the leading end of the printed paper S or the image-fixed paper Sa.

The belt drawing and conveying portion 29 comprises; a driven roller 30 whose upstream end is connected to a paper discharge port of the stencil printing device main body 1 and disposed on the upstream side of the paper conveyance direction X; a driving roller 31 disposed on the downstream side of the paper conveyance direction X; an endless paper conveying belt 32 which is wrapped around each of the rollers 30, 31; a suction fan 33 which draws and holds the printed paper S on the paper conveying belt 32; and the belt drive motor 34 which acts as driving means for rotary driving the driving roller 31 by means of the endless belt.

The two of the UV lamps 36*a*, 36*b* and the UV auxiliary lamp 54 are attached to and supported by the lamp housing 37 which is disposed so as to cover the lamps 36*a*, 36*b*, and 54 from the top. Each of the UV lamps 36*a*, 36*b* and the UV auxiliary lamp 54 configure a lamp unit 25 integrated with the lamp housing 37, as shown in FIG. 3.

The air in the UV irradiation portion, which is partially ozonized by the UV radiation from the lamps 36*a*, 36*b* and 54, is drawn by a suction fan (not shown), conveyed by a duct 38, passes through an ozone filter 39 which absorbs and eliminates the generated ozone, and is then discharged from a discharge duct 40 to the outside.

As described above, the ultraviolet irradiation means comprises the UV lamps 36*a*, 36*b*, UV auxiliary lamp 54, housing 37, suction fan, duct 38, ozone filter 39, discharge duct 40, and the like. It should be noted that the ultraviolet irradiation means does not have the conveyance mechanism (the belt drawing and conveying portion 29, pair of discharge rollers 41, 42, belt drive motor 34 and the like) of the UV irradiation apparatus 2.

Figure 3:
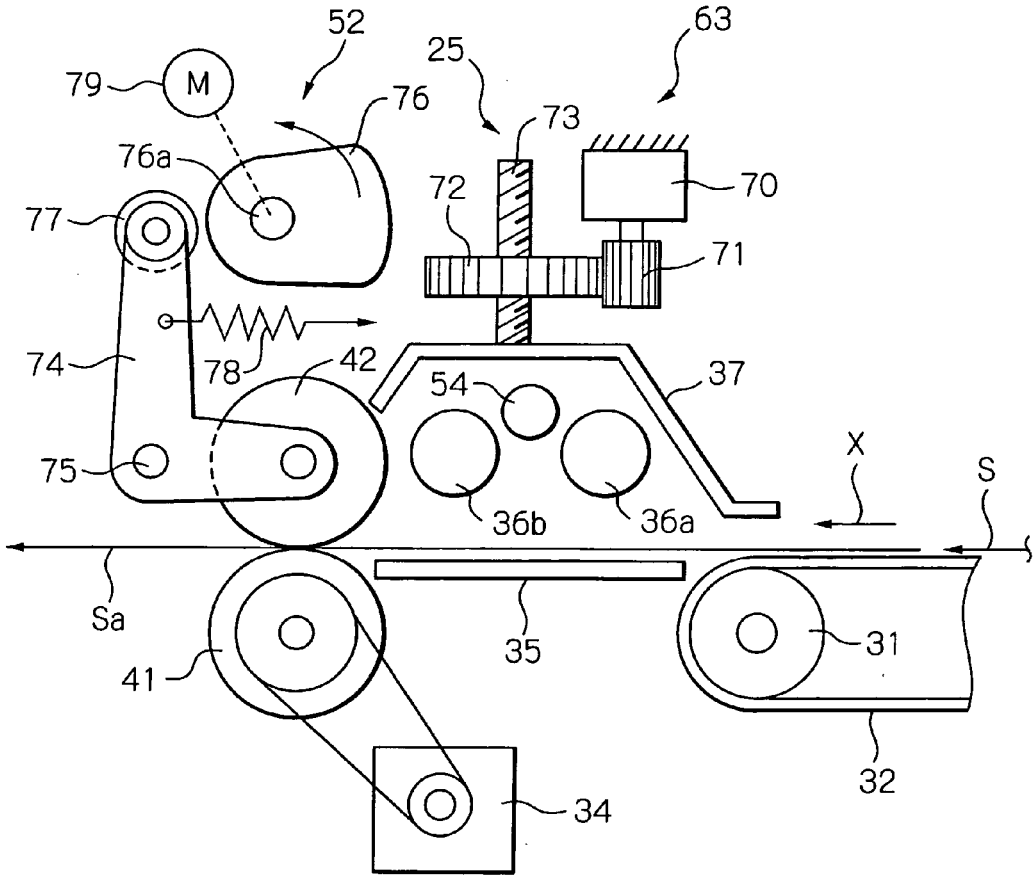
FIG. 3 is a front view of a UV lamp height position changing drive mechanism and a discharge roller pressure release drive mechanism in a UV irradiation apparatus of the stencil-printing device.

As shown in FIG. 3, the UV lamp height position changing drive mechanism 63 mainly comprises: an unshown guide member (for example, a rail-like guide member) which acts as guiding means for supporting and guiding the lamp unit 25 such that the lamp unit 25 can be lifted up and down; a screw axis 73 fixed to the lamp housing 37 and extending vertically; a gear 72 which engages with the screw axis 73; and a lifting motor 70 in which a gear 71 engaging with the gear 72 is fixed to an output axis.

The guide member and the lifting motor 70 are fixed to the main body of the UV irradiation apparatus 2. As the lifting motor 70, for example, preferably a stepping motor is used. The gear 72 is rotatably supported on the main body of the UV irradiation apparatus 2 via an unshown axis.

The initial position of the lamp unit 25 is detected by, for example, the transmission-type photosensor (or a limit switch) being engaged with an unshown shading plate (or a member pressing the limit switch), which protrudes outward from the lamp housing 37 and engages with the transmission-type photosensor in the initial position of the lamp unit 25, the transmission-type photosensor being fixed to the main body of the UV irradiation apparatus 2. Further, the initial position is recognized by transmitting a signal related to the initial position to the UV irradiation control device 56 shown in FIG. 4.

As shown in FIG. 3, the discharge roller pressure release drive mechanism 52 mainly comprises: an arm 74, one end of which pivotably supports the upper discharge roller 42 via the axis 75 supported rotatably in the main body of the UV irradiation apparatus 2, and the other end of which rotatably supports a cam follower 77; a cam 76 which is fixed to a cam shaft 76*a* supported rotatably on the main body side of the UV irradiation apparatus 2; a spring 78 which acts as biasing means for constantly biasing in the direction for causing the cam follower 77 to contact with the cam 76; an unshown gear which is fixed to the cam shaft 76*a*; and a cam motor 79 in which a gear engaging with the gear is fixed to an output axis, the cam motor 79 being shown simply in the figure. The initial position of the cam 76 also is detected/recognized as a configuration based on the initial position of the lamp unit 25. The cam motor 79 is fixed to the main body of the UV irradiation apparatus 2.

The operation panel 58 of the stencil printing device main body 1 is described with reference to FIG. 2.

In the operation panel 58, there are disposed a master-making start key 68A for starting a series of operations such as master-making operation, a print start key 68B for starting regular print operation for the set number of print pages, a ten key 69 for registering the number of print pages and the like, the printing speed switching keys 59*a*, 59*b* as printing speed setting means for setting the printing speed, a printing speed display device 60 configured from five LEDs (light emitting diode) and acting as printing speed display means for displaying a set printing speed, a UV fixation degree standard setting key 61 and UV fixation degree strong setting key 62 as UV fixation degree setting means for instructing/setting the UV fixation degree when performing UV printing, a liquid crystal display device 64 as warning display means/warning signaling means for displaying/signaling or changing various set conditions such as master-making/print set conditions, and displaying/signaling a warning such as paper jam or various erroneous operations, and four instruction keys 65*a*, 65*b*, 65*c*, 65*d* used when instructing about various set conditions.

The printing speed switching keys 59*a*, 59*b* are well-known devices, which are pressed when setting the printing speed prior to a printing operation, to set the printing speed low when obtaining a dense image or when the ambient temperature is low, and to set the printing speed high when obtaining a sparse image or when the ambient temperature is high.

In the printing speed display device 60, three speeds displayed as "3" in the center painted in black indicate the standard printing speed corresponding to the printing speed which is used normally, and are set automatically when the printing speed switching keys 59*a*, 59*b* are not pressed. "First speed" at the far left in the printing speed display device 60 is set to 60 pages/min:60 rpm, which is the lowest speed, "second speed" on the immediate right side of the first speed is set to 75 pages/min:75 rpm, the standard printing speed of "third speed" is set to 90 pages/min:90 rpm, "fourth speed" on the immediate right side of the third speed is set to 105 pages/min:105 rpm, and "fifth speed" at the far right is set to 120 pages/min:120 rpm, which is the highest speed.

The UV fixation degree standard setting key 61 is used for setting the UV fixation degree to standard UV fixation, and the UV fixation degree strong setting key 62 is used for setting the UV fixation degree of the ink on an image to a strong fixation degree.

The liquid crystal display device 64 displays display portions such as "ink," "paper," "paper type 66," and "image type 67" as needed according to the hierarchical display structure of these display portions.

On the display portion for the ink, a ink type is displayed automatically on the basis of detection results from the drum unit ink type identifying sensor 51 and the drum unit ink color identifying sensor 53. Similarly, on the display portion for the paper, a paper size is displayed automatically on the basis of a detection result from the paper size detection sensor 57. The example in the figure shows a case a black UV ink is used.

An operator inputs an instruction, regarding the display portion for the paper type 66 and the display portion for the image type 67. When there is no particular inputs by an operation from the operator, the paper type 66 is set, in advance, to "plain paper" and the image type 67 to "solid picture included."

Regarding an example of the operation settings for the paper type 66 and image type 67, after the operator moves a cursor to each of the display portions by means of the instruction keys 65*a*, 65*b*, 65*c*, 65*d*, a desired paper time and image type are displayed, and further displayed inverted in black and white, whereby selection setting is performed. Alternatively, selection setting may be performed by means of a touch panel system having a softkey.

It should be noted that the operation panel 48 may be disposed in the UV irradiation apparatus 2 as well. For example, except the master-making start key 68A, print start key 68B, printing speed switching keys 59*a*, 59*b*, and printing speed display device 60 which are disposed on the operation panel 58 of the stencil printing device main body 1, various other keys such as UV fixation degree standard setting key 61, UV fixation degree strong setting key 62, instruction keys 65*a*, 65*b*, 65*c*, 65*d*, ten key 69, liquid crystal display device 64 and the like may be disposed partially redundantly on the operation panel 48 in the UV irradiation apparatus 2 according to need.

Next, the main control configurations of the stencil printing device main body 1 and the UV irradiation apparatus 2 are described with reference to FIG. 4.

In the figure, the stencil printing control device 55 comprises CPU (central processing unit), I/O (input/output) port, ROM (read-only memory), RAM (random access storage unit), timer, and the like, which are not shown, and comprises a microcomputer which has a configuration in which the above components are connected to each other via a single bus which is not shown. The stencil printing control device 55 is provided in a control board disposition portion inside the stencil printing device main body 1.

The UV irradiation control device 56 also comprises a microcomputer which is substantially same as that of the stencil printing control device 55 described above. The UV irradiation control device 56 is provided in a control board disposition portion inside the UV irradiation apparatus 2. The stencil printing control device 55 and the UV irradiation control device 56 exchange various command signals, on/off signals, or data signals by performing serial communication with each other.

In the stencil printing control device 55, the CPU of the stencil printing control device 55 (sometimes simply referred to as "stencil printing control device 55", hereinafter in order to simplify the explanation) has a function of, mainly, performing master-making/master-loading on the stencil printing device main body 1 including the thermal head 13 via a stencil master-making portion drive control circuit, and a function of controlling print operations including feeding and discharging papers via the stencil printing portion drive control circuit, on the basis of various signals from the operation panel 58 and detection signals from the abovementioned various sensors provided inside the stencil printing device main body 1, and operation programs called up from the ROM and related data. The stencil printing control device 55 further has a function of performing draft reading operation and paper feed operation, and of controlling the liquid crystal display device 64 of the operation panel 48. The stencil printing control device 55 further has a function as control means for performing control specific to the present embodiment, which is described hereinafter.

Operation programs for the entire stencil printing device main body 1 and necessary related data are stored in the ROM in advance. The operation programs are called up by the CPU accordingly. The RAM has a function of temporarily storing computation results from the CPU, and a function of storing, according to need, data signals, which are set or input by the various keys and various sensors on the operation panel 58, and on-off signals.

The CPU of the UV irradiation apparatus 56 (sometimes simply referred to as "UV irradiation control device 56" hereinafter in order to simplify the explanation) has a function of controlling mainly the belt drawing and conveying portion 29 and the belt drive motor 34 of the pair of discharge rollers 41, 42 in the UV irradiation apparatus 2 via a conveyance belt control circuit, and controlling the UV lamps 36*a*, 36*b*, UV auxiliary lamp 54, cam motor 79 of the discharge roller pressure release drive mechanism 52, lifting motor 70 of the UV lamp height position changing drive mechanism 63, and a liquid crystal display device (not shown) of the operation panel 48 via a UV lamp lighting control circuit, on the basis of the various signals from the operation panel 48, the detection signals from the various sensors provided in the UV irradiation apparatus 2, the operations programs called out from the ROM, and the related data. The UV irradiation control device 56 further has a function as control means for controlling the stencil printing control device 55 and for performing control specific to the present invention, which is described hereinafter.

Operation programs for the entire UV irradiation apparatus 2 and necessary related data are stored in the ROM of the UV irradiation control device 56 in advance. The operation programs are called up by the CPU accordingly. The RAM of the UV irradiation control device 56 has a function of temporarily storing computation results from the CPU, and a function of storing, according to need, data signals, which are set or input by the various keys and various sensors on the operation panel 48, and on-off signals.

The stencil printing control device 55 and the UV irradiation control device 56 have a function performing following control operations while referring and calling up the operation programs stored in the ROM.

Specifically, the stencil printing control device 55 and the UV irradiation control device 56 have a basic function as first control means for causing, of the UV lamps 36*a*, 36*b* and the UV auxiliary lamp 54, at least the UV lamps 36*a*, 36*b* to operate when attachment of the print drum unit for UV ink is detected, and stopping the operations of the UV lamps 36*a*, 36*b* and UV auxiliary lamp 54 when attachment of the drum unit for non-UV ink is detected, on the basis of signals from the drum unit ink type identifying sensor 51.

The stencil printing control device 55 and the UV irradiation control device 56 further have a function as second control device for causing the liquid crystal display device 64 to perform displaying/signaling of a warning when attachment of the print drum unit for UV ink is detected and when the set printing speed, which is set by the printing speed switching keys 59*a*, 59*b*, exceeds the printing speed for ultraviolet irradiation, which is set in advance in accordance with ultraviolet irradiation by the UV lamps 36*a*, 36*b* and UV auxiliary lamp 54, on the basis of signals from the drum unit ink type identifying sensor 51, and/or changing the set printing speed to the printing speed for ultraviolet irradiation.

The stencil printing control device 55 and the UV irradiation control device 56 further has function as third control means for controlling the belt drive motor 34 so as to make a change to the conveying speed of the paper conveying belt 32 and of the pair of discharge rollers 41, 42 in accordance with printing speed information, which is set by the printing speed switching keys 59*a*, 59*b*, and conveyance direction size information of the paper S from the paper size detection sensor 57, when attachment of the print drum unit for TV ink is detected, on the basis of the signals from the drum unit ink type identifying sensor 51.

The stencil printing control device 55 and the UV irradiation control device 56 further has a function as fourth control means for controlling the UV lamps 36*a*, 36*b* and the UV auxiliary lamp 54 so as to change UV radiation energy received by the printed paper S, in accordance with at least one type of information of paper type information which is set in the paper type 66 of the liquid crystal display device 64, image type information which is set in the image type 67 of the liquid crystal display device 64, and instruction information from the UV fixation degree standard setting key 61 or UV fixation degree strong setting key 62, when attachment of the print drum unit for UV ink is detected, on the basis of the signals from the drum unit ink type identifying sensor 51.

The stencil printing control device 55 and the UV irradiation control device 56 further has a function as fifth control means for controlling the UV lamps 36*a*, 36*b* and the UV auxiliary lamp 54 so that the radiation energy becomes larger than the UV radiation energy received by the printed paper S in the case in which the ink used is a color other than black, when attachment of the print drum unit for UV ink is detected, on the basis of the signals from the drum unit ink type identifying sensor 51, and when attachment of the print drum unit for black UV ink is detected, on the basis of the signals from the drum unit ink color identifying sensor 53.

The stencil printing control device 55 and the UV irradiation control device 56 further has a function of changing the UV radiation energy received by the printed paper S by changing at least one of the following: the output of the UV lamps 36*a*, 36*b* and the UV auxiliary lamp 54; the number of times of light emission from the UV lamps 36*a*, 36*b* and the UV auxiliary lamp 54; and the lifting motor 70 of the UV lamp height position changing drive mechanism 63 which changes the space between the printed paper S, and the UV lamps 36*a*, 36*b* and UV auxiliary lamp 54.

The stencil printing control device 55 and the UV irradiation control device 56 further has a function as sixth control means for controlling the belt drive motor 34 so that the belt drawing and conveying portion 29 and pair of discharge rollers 41, 42 only are driven when attachment of the print drum unit for non-UV ink is detected and a print instruction is issued, on the basis of the signals from the drum unit ink type identifying sensor 51.

The stencil printing control device 55 and the UV irradiation control device 56 further has a function as seventh control means for performing control of at least the first control means of the first to sixth control means, which are performed by the stencil printing control device 55 and the UV irradiation control device 56, when a connection between the UV irradiation apparatus 2 and stencil printing device main body 1 is detected, on the basis of signals from the UV irradiation apparatus connection detection sensor 50 and the stencil printing device main body connection detection sensor 49.

The stencil printing control device 55 and the UV irradiation control device 56 further has a function as eighth control means for causing the liquid crystal display device 64 to perform displaying/signaling of a warning when a connection between the UV irradiation apparatus 2 and stencil printing device main body 1 is detected, on the basis of the signals from the UV irradiation apparatus connection detection sensor 50 and the stencil printing device main body connection detection sensor 49, and when attachment of the print drum unit for non-UV ink is detected, on the basis of the signals from the drum unit ink type identifying sensor 51.

Operation related to, mainly, the control sequence of the stencil printing device main body 1 and the UV irradiation apparatus 2 in the present embodiment is described on the basis of the abovementioned configuration, with reference to the flowcharts of FIG. 7 and FIG. 8.

This operation is performed under control of the stencil printing control device 55 and the UV irradiation control device 56, thus an expression such as "on the basis of commands or command signals from the stencil printing control device 55 and the UV irradiation control device 56" is omitted as much as possible when describing detailed operations such as actuating, operating, stopping and the like of the actuators (control target driving means) such as the UV lamps 36*a*, 36*b*, UV auxiliary lamp 54, and various motors. The flowcharts of FIG. 7 and FIG. 8 are illustrated to the extent that those skilled in the art can easily understand, and contents which are less important or other details are omitted in order to avoid confusion in understanding the figures.

Moreover, the operations from step S1 through step S19 executed in the stencil printing device main body 1, and the operations from step S20 through S32 executed in the UV irradiation apparatus 2 are described collectively, since they are loosely related to each other.

In the stencil printing device main body 1, a draft (not shown) is scanned, a processed master is created on the basis of an image on the draft (or image data which is input from a personal computer or the like as an external input device via a controller) as described above, versioning operation of filling the processed master on the print drum 17 with ink is performed or well-known operation called "proof print" is performed, the print drum 17 being wrapped with the processed mask, and thereafter the number of prints is registered/set by means of the ten key 69 and the print start key 68B is pressed, whereby normally the operation of the stencil printing device main body 1 is started. However, in the present embodiment, first of all, whether the UV irradiation apparatus 2 is connected to the stencil printing device main body 1 is checked/judged on the basis of a signal from the UV irradiation apparatus connection detection sensor 50 (step S1). At the same time, in the UV irradiation apparatus 2 as well, whether the stencil printing device main body 1 is connected is checked/judged on the basis of a signal from the stencil printing device main body connection detection sensor 49 (step S20).

Here, in the case in which the UV irradiation apparatus 2 is not connected, the process proceeds to step S11, it is checked that the paper discharge tray 44 is attached, on the basis of a signal from the paper discharge tray attachment detection sensor 45 since non-UV printing is performed, and then master making is performed under the master-making conditions for non-UV radiation to directly perform stencil printing of the indicated number of pages (step S12).

If the paper discharge tray 44 is not attached in the step S11, the liquid crystal display device 64 is caused to display a warning such as "please attach the paper discharge tray" or the like (step S13). It should be noted that lighting/blinking display by means of an LED or the like may be employed instead of displaying a warning. Alternatively, voice warning by means of, for example, an appropriate buzzer, or an appropriate combination of the lighting/blinking warning and a voice warning may be used (same hereinafter).

On the other hand, when it is judged that the UV irradiation apparatus 2 is not connected to the stencil printing device main body 1, the process proceeds to step S28 in which the liquid crystal display device of the operation panel 48 of the UV irradiation apparatus 2 is caused to display "please connected to the stencil printing device main body."

If the UV irradiation apparatus 2 is connected in the step S1, the process proceeds to step S2 in which whether the attached print drum is the print drum unit for UV ink or not is checked/judged on the basis of a signal from the drum unit ink type identifying sensor 51. If the attached print drum is not the print drum unit for UV ink, the liquid crystal display device 64 is caused to display a warning related to the drum unit attachment error, such as "please check the attached drum unit" (step S14). If replacement with the print drum unit for UV ink is not made and the print start key 68B is pressed again (step S15, step S16), the process proceeds to step S17, and non-UV printing is performed while keeping the UV irradiation apparatus 2 connected, thus the stencil printing control device 55 issues a command of "execute non-UV printing" to the UV irradiation control device 56 of the UV irradiation apparatus 2 to start printing (step S17).

In the UV irradiation apparatus 2, if there is the command of "execute non-UV printing" from the stencil printing control device 55, the printed paper S, which is conveyed by the belt drawing and conveying portion 23 of the stencil printing device main body 1, is further conveyed to the downstream side of the paper conveyance direction X while being drawn toward the surface of the paper conveying belt 32 by the suction fan 33 of the belt drawing and conveying portion 29 of the UV irradiation apparatus 2. The printed paper S is further rotatably conveyed and at the same time guided along the metal guide plate 35 by the drive of the belt drive motor 34, while being drawn by the suction fan 33 toward the surface of the paper conveying belt 32 of the belt drawing and conveying portion 29 of the UV irradiation apparatus 2.

Furthermore, in the UV irradiation apparatus 2, the cam motor 79 of the discharge roller pressure release drive mechanism 52 is driven to release the pressure of the upper discharge roller 42 against the lower discharge roller 41, and at the same time the belt drive motor 34 is driven at speed corresponding to the printing speed of the stencil printing device main body 1 without causing each UV lamps 36*a*, 36*b*, and 54 to blink. The printed papers S (printed matters), which are conveyed by the paper conveying belt 32 and lower discharge roller 41 in the abovementioned manner, are received by the end fence 43, and dropped/stacked on the paper discharge tray 44 in an orderly manner, with the leading edges of the papers being adjusted (step S21 through step S31).

If the attached drum unit is the drum unit for UV ink in the step S2, the process further proceeds to step S3 in which whether the ink is black or not is checked/judged on the basis of a signal from the drum unit ink color identifying sensor 53. In the case of "black ink," a command of "black ink" is sent to the UV irradiation control device 56. In this case in the UV irradiation apparatus 2, strong radiation is required compared to the case in which an ink of other color is used, thus control is performed so as to cause the UV lamps 36*a*, 36*b* and the UV auxiliary lamp 54 to blink (step S22, step S32). This is because carbon inside the black ink has a characteristic of disturbing transmission of UV (ultraviolet) light, as described above.

Next, the process proceeds to step S4, wherein whether the set printing speed is at the third speed or lower or at the fourth speed or higher is judged in the stencil printing control device 55. The printing speed of the stencil printing device main body 1 can be selected from the five steps o the first speed (low speed) to the fifth speed (high speed), as described above. In the case of UV printing, the paper conveying speed has to be set to the low speed to provide sufficient UV radiation energy, although there is no such problem in the case of non-UV printing. Therefore, the liquid crystal display device 64 is caused to display a warning such as "please set the printing speed to the third speed or lower in order to secure UV fixation" in the case in which the printing speed is set to the fourth speed or fifth speed. Alternatively, the printing speed is forcibly changed to the third speed automatically by means of the main motor (not shown) of the print drum 17 on the basis of a command from the stencil printing control device 55. The printing speed is not changed of course if it is remained in the first, second, or third speed.

The stencil printing control device 55 further transmits necessary information or a command to the UV irradiation control device 56. The stencil printing control device 55 first transmits a message of "UV printing", and then transmits information on the printing speed determined above (first speed to third speed). Further, on the paper feed tray 7 of the stencil printing device main body 1, the paper size and the conveyance direction length can be detected by the paper size detection sensor 57, thus the stencil printing control device 55 transmits information on the paper size is transmitted to the UV irradiation control device 56 (step S5 through step S7).

The UV irradiation control device 56 selects an optimal paper conveying belt driving speed on the basis of the printing speed information and the paper size information, and drives the belt drive motor 34 at the selected speed.

FIG. 9 shows an example in which related data is stored in the ROM in advance when the UV irradiation control device 56 selects/determines an optimal driving speed of the paper conveying belt 32 and the pair of discharge rollers 41, 42 on the basis of the printing speed information and the paper size information (step S23).

The unit for the numeric values in the figure indicates the paper conveying speed (cm/sec) of the paper conveying belt 32 and the pair of discharge rollers 41, 42.

Figure 5:
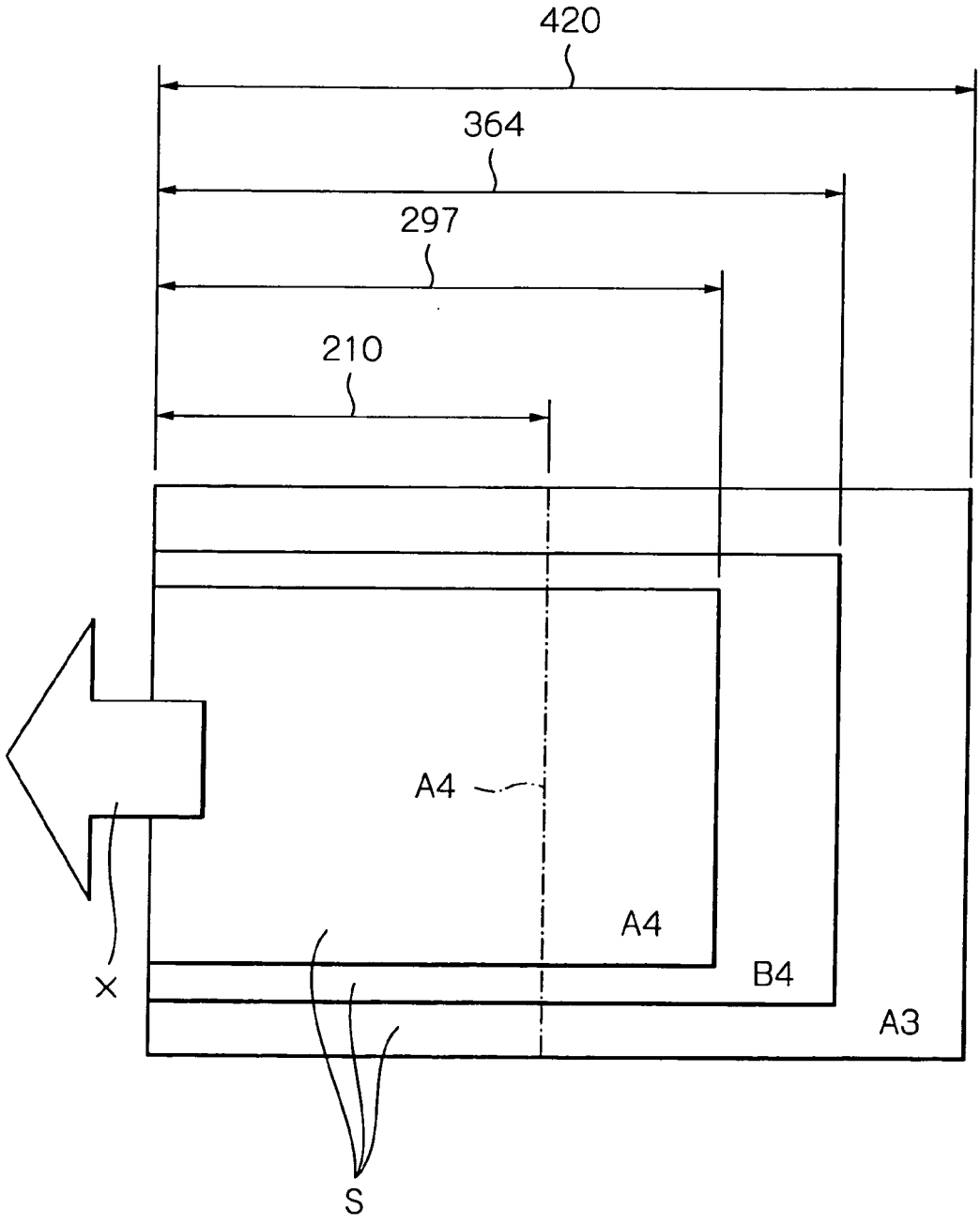
FIG. 5 is a figure for explaining that the length of a paper conveyance direction varies according to the size of a paper.

FIG. 5 shows that the conveyance direction length of the paper S varies according to the paper size or conveyance direction size of the paper S.

Figure 6A:
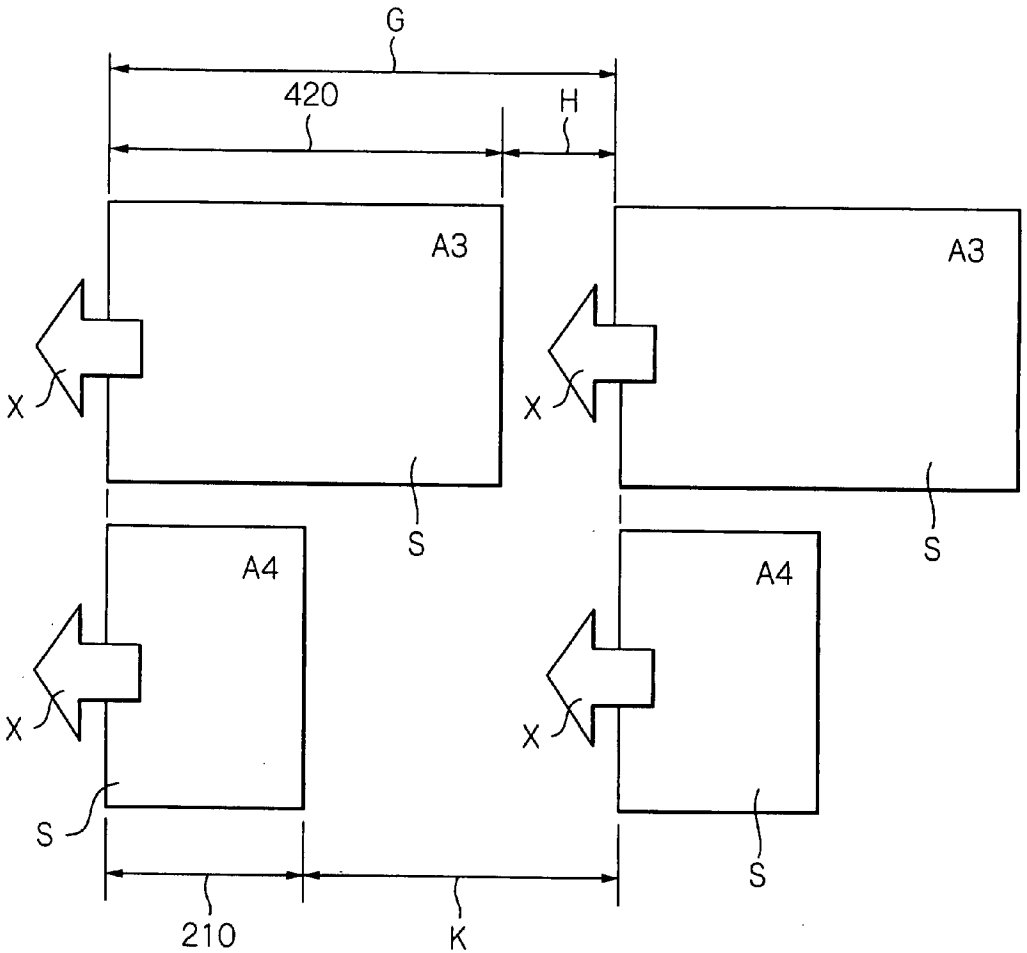
FIG. 6A is a figure for explaining the paper interval between a case in which an A3 size paper is placed in a longitudinal conveyance direction (horizontally) and a case in which an A4 size paper is placed in a width direction (vertically)
Figure 6B:
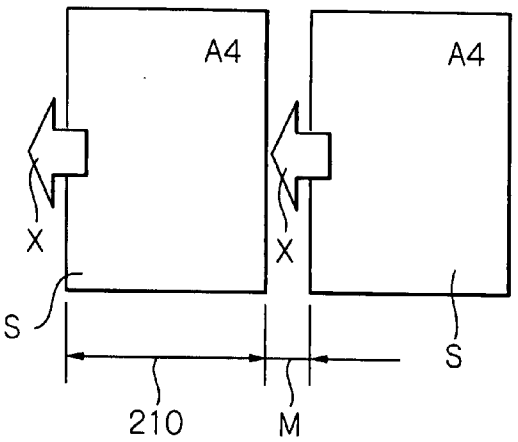
FIG. 6B is a figure for explaining the difference in the paper interval between a case in which an A3 size paper is placed in a longitudinal conveyance direction (horizontally) and a case in which an A4 size paper is placed in a width direction (vertically)

In the stencil printing device main body 1, always one piece of paper S is sent out per rotation of the print drum 17 regardless of the size of the paper, thus, as shown in FIG. 6A, the interval conveyed papers varies according to the size of the papers. In the figure, in the case of the longitudinal conveyance (or longitudinal feeding) of an A3 size paper S, the paper length in the paper conveyance direction X is 420 mm, and the paper span is G. However, in the case of the width conveyance (or width feeding) of an A4 size paper S, the paper length in the paper conveyance direction X is 210 mm, thus the paper span is K. In consideration of reduction of the printing time, it is not preferred to convey the papers in the UV irradiation apparatus 2 as well when the paper span is K. Therefore, as shown in FIG. 6B, by controlling the belt drive motor 34 so as to reduce the paper conveying speed of the paper conveyance belt 32 and pair of discharge rollers 41, 42 of the TV irradiation apparatus 2, the paper span is reduced to M. In this manner, UV irradiation from each lamp 36*a*, 36*b*, and 54 can be effectively applied to the printed matters. In the case of the A3 size paper S as well, the paper span H is reduced slightly by controlling the belt drive motor 34 so as to reduce the paper conveying speed of the paper conveying belt 32 and pair of discharge rollers 41, 42 of the UV irradiation apparatus 2.

The paper type information related to printing paper type information is input by the operator using the operation panel 58 as described above, thus the stencil printing control device 55 sets the information about the paper type 66 by means of the operation panel 58, and transmits the information to the UV irradiation control device 56 (step S8). The UV irradiation control device 56 controls the UV lamps 36*a*, 36*b*, and the UV auxiliary lamp 54 so as to adjust, i.e. to change the UV radiation energy received by a printed paper S, in order to change the outputs of the UV lamps 36*a*, 36*b*, and UV auxiliary lamp 54, in accordance with the paper type information.

FIG. 10 shows an example in which related data is stored in the ROM in advance when the UV irradiation control device 56 selects/determines a UV lamp output level in accordance with the paper type (step S24).

The figure is illustrated based on the fact that a plain paper normally transmits UV ink, thus less amount of the UV ink remains on the paper surface, and that a postcard or a coated paper, on the other hand, does not transmit UV ink well, thus the UV ink cannot be dried and fixed sufficiently to the paper surface unless the stronger UV radiation energy is applied.

Next, the image type information related to the type of a printed image is also input by the operator using the operation panel 58 as described above, thus the stencil printing control device 55 transmits the information to the UV irradiation control device 56 (step S9). The UV irradiation control device 56 controls the UV lamps 36*a*, 36*b*, and the UV auxiliary lamp 54 so as to adjust, i.e. to change the UV radiation energy received by a printed paper S, in order to change the outputs of the UV lamps 36*a*, 36*b*, and UV auxiliary lamp 54, in accordance with the printed image type information.

FIG. 11 shows an example in which related data is stored in the ROM in advance when the UV irradiation control device 56 selects/determines the UV lamp output level in accordance with the printed image type (step S25).

The figure is illustrated based on the fact that, in the case of an image with characters, generally less amount of a UV ink is transmitted to the surface of the paper with a predetermined dimension, compared to the case of a solid image or photograph, thus the ink can be dried and fixed to the paper surface sufficiently even with small application of UV radiation.

Changing and adjustment of the outputs of the UV lamps 36*a*, 36*b*, and UV auxiliary lamp 54 are performed by changing power supplied to each lamp 36*a*, 36*b*, and 54, or the outputs can be changed using a method of blinking using some of the plurality of lamps 36*a*, 36*b*, and 54.

In fact, when the UV fixation degree strong setting key 62 on the operation panel 58 is pressed by the operator, the UV irradiation control device 56 drive-controls the lifting motor 70 of the UV lamp height position changing drive mechanism 63 in response to instruction information on fixation degree, which is sent by the stencil printing control device 55, and drops the position of the UV lamp unit more towards the printed image conveyance surface of a printed paper S. However, if this operation is performed excessively, a conveyance jam occurs, or the surface of the image-fixed paper Sa easily forms waves, thus attention is necessary in this operation (step S10)

Further, the UV irradiation control device 56 determines an optimal paper conveying speed of the paper conveying belt 32 and the pair of discharge rollers 41, 42, and the outputs of the UV lamps 36*a*, 36*b*, and the UV auxiliary lamp 54, on the basis of the above FIG. 9 through FIG. 11 (step S26).

The UV irradiation control device 56 eventually causes the UV lamps 36*a*, 36*b*, and UV auxiliary lamp 54, which are selected and determined on the basis of FIG. 10 and FIG. 11, to blink by means of predetermined outputs, and at the same time drives the belt drive motor 34 at the paper conveying speed of the paper conveying belt 32 and pair of discharge rollers 41, 42, which is selected and set on the basis of FIG. 9 (step S27).

The present invention can be used or applied in not only the abovementioned stencil printing device, but also in the printing device having a configuration which can be called an "intaglio printing device" for supplying inks from outside of the print drum, i.e. for supplying inks to the master on the print drum to form a printed image on a paper S, as disclosed in Japanese Patent Application Laid-Open No. H07-17013. In other words, the present invention can be used or applied in a printing device which performs printing by pressing a paper S directly or indirectly (for example, via a transfer cylinder) against a printing plate on the print drum, while supplying non-UV ink or UV ink to the printing plate including the master wrapped around the print drum.

The present invention has the following characteristics.

(1) The first control means operates the UV irradiation means when attachment of the print drum for UV curable ink is detected by the print drum detection means, and stops the operation of the UV irradiation means when attachment of the print drum for non-UV curable ink is detected, whereby the UV irradiation means appropriately operates even when detaching or replacing the "print drum for UV curable ink" and "print drum for non-UV curable ink", and operativity can be improved. Therefore, while aiming the improvement of the drying performance on a paper (printed matter) printed with the UV curable ink with UV radiation by means of the UV irradiation means, UV irradiation can be prevented from being performed using the UV irradiation means when the print drum for non-UV curable ink is attached by mistake.

(2) The second control means can make a change to execution of signaling a warning and/or to the printing speed for UV irradiation when attachment of the print drum for UV curable ink is detected by the print drum detection means and when the set printing speed which is set by the printing speed setting means exceeds the printing speed for UV irradiation, which is set in advance in accordance with UV irradiation by the UV irradiation means, whereby optimal control can be performed with the minimum UV radiation energy in response to the printing speed of the printing device, even when using the UV irradiation means in which the least possible amount of electricity is consumed and less heat is generated. Therefore, the electric power consumption and heat value are reduced, the risk of the unexpected occurrence of fire can be avoided, the ozone yield from the UV irradiation means is reduced, whereby the occurrence of health problems to the operator can be avoided, and discoloration or waves on the paper due to heat can be reduced.

(3) The third control means controls the paper conveyance driving means so as to make a change to the conveying speed of the paper conveying means in response to the printing speed information and the paper conveyance direction size information when attachment of the print drum for UV curable ink is detected by the print drum detection means, thereby reducing the conveying speed of the paper conveying means to the speed appropriate for improving the drying performance on a printed matter on which the UV curable ink is printed, and minimizing the intervals between the printed papers, thus UV irradiation by the UV irradiation means can be effectively applied to the printed matters.

(4) The fourth control means controls the UV irradiation means so as to change the radiation energy received by the printed paper, in response to at least one type of information of the paper type information, image type information, and fixation degree instruction information, when attachment of the print drum for UV curable ink is detected by the print drum detection means. Therefore, the fourth control means can previously prevent the occurrence of problems such that, in the case of printing on a postcard or coated paper used as the paper type information, the amount of UV radiation is not enough to dry and fix the UV curable ink because only small amount of the UV curable ink is transmitted. Moreover, the fourth control means can hold the UV radiation energy to a minimum in the case of printing using a plain paper. In the case of a printed matter as the image type information with a large portion of, for example, solid image, the fourth control means can previously prevent the occurrence of problems such that the amount of UV radiation is not enough to dry and fix the UV curable ink, and can hold the UV radiation energy to a minimum in the case of a normal image with characters.

(5) When attachment of the print drum for UV curable ink is detected by the print drum detection means, and when attachment of the print drum for black UV curable ink is detected by the ink color detection means, the fifth control means controls the UV radiation means so that the radiation energy becomes larger than radiation energy received by the printed paper in the case of using a color of ink other than black. Accordingly, in the case of the fixing performance of a printed matter obtained by attaching the print drum for black UV curable ink, strong UV radiation is required, compared to the case in which other colors are used. Therefore, it is possible to avoid a problem that insufficient fixing performance is obtained in the case of the printed matter when the black UV curable ink is used, and, at the same time, the UV irradiation can be reduced to a minimum in the case of the fixing performance on the printed matter obtained by attaching the print drum for other UV curable ink.

(6) The UV irradiation means changes the radiation energy received by the printed paper by changing at least one item of the outputs of the UV radiation lamps, the number of times of light emission from the plurality of UV radiation lamps, and the space between the UV radiation lamps and the printed paper. Therefore, when the operator wishes to change particularly the UV radiation fixation degree, the operator can issue an instruction to change the degree of fixation at his/her request, thus an image can be fixed onto the paper obtained by attaching the print rum for UV curable ink, by using stronger UV radiation.

(7) The sixth control means controls the paper conveyance driving means so that only the paper conveyance means is driven, when attachment of the print drum for non-UV curable ink is detected by the print drum detection means and when a print instruction is issued. Accordingly, the sixth control means can responds to printing in which the print drum for non-UV curable ink is used even when the UV irradiation means is connected. Specifically, it is possible to eliminate troublesome operations, such as disconnecting and moving the UV irradiation means every time when performing stencil printing with non-UV radiation by means of the print drum for non-UV ink.

(8) The seventh control means performs at least control operation of the first control means of the control operations performed by the first to sixth control means when a connection of the UV irradiation means to the printing device main body is detected by the connection detection means, thereby obtaining at least the above characteristic (1) related to the control operation of the first control means, and the above characteristics (2) to (7) related to at least one control operation of the control operations performed by the second to sixth control means.

(9) The eighth control means signals a warning when a connection of the UV irradiation means to the printing device main body is detected by the connection detection means and when attachment of the print drum for non-UV curable ink is detected by the print drum detection means. Accordingly, the eighth control means can notify, in advance, the operator of that the UV irradiation means is in an non-operated state, whereby the operator can recognize that the printing is performed without the UV curable ink, i.e. normal printing using the non-UV curable ink is performed.

Various modifications will become possible for those skilled in the art after receiving the teachings of the present disclosure without departing from the scope thereof.

What is claimed is:

1. A printing device, comprising:

ultraviolet irradiation means for irradiating a printed paper with ultraviolet radiation;

attaching/detaching means for selectively attaching and detaching to and from a printing device main body a print drum for ultraviolet curable ink, installed with an ultraviolet curable ink, and a print drum for non-ultraviolet curable ink, installed with a non-ultraviolet curable ink;

print drum detection means for detecting whether the print drum attached to the printing device main body via the attaching/detaching means is either the print drum for ultraviolet curable ink or the print drum for non-ultraviolet curable ink;

first control means for operating the ultraviolet irradiation means when attachment of the print drum for ultraviolet curable ink is detected by the print drum detection means, and stopping the operation of the ultraviolet irradiation means when attachment of the print drum for non-ultraviolet curable ink is detected by the print drum detection means;

paper conveying means for conveying a printed paper to be irradiated with the ultraviolet radiation, a paper conveying speed of the paper conveying means increasing as a printing speed increases, and the paper conveying speed of the paper conveying means decreasing as a paper size in a paper conveyance direction decreases;

paper conveyance driving means for driving the paper conveying means; and second control means for controlling the paper conveyance driving means so as to make a change to conveying speed of the paper conveying means in response to printing speed information and paper conveyance direction size information only when attachment of the print drum for ultraviolet curable ink is detected by the print drum detection means such that a distance between consecutive printed papers is changed by the second control means from a first distance before the paper conveyance driving means to a second distance after the paper conveyance driving means.

2. The printing device as claimed in claim 1, further comprising:

printing speed setting means for setting printing speed; and third control means for making a change to execution of signaling a warning and/or to printing speed for ultraviolet irradiation when attachment of the print drum for ultraviolet curable ink is detected by the print drum detection means and when set printing speed which is set by the printing speed setting means exceeds the printing speed for ultraviolet irradiation which is set in advance in accordance with ultraviolet irradiation by the ultraviolet irradiation means.

3. The printing device as claimed in claim 1, further comprising third control means for controlling the ultraviolet irradiation means so as to change radiation energy which the printed paper receives, in response to at least one type of information of paper-type information, image-type information, and fixation-degree instruction information, when attachment of the print drum for ultraviolet curable ink is detected by the print drum detection means.

4. The printing device as claimed in claim 3, wherein the ultraviolet irradiation means is configured so as to change the radiation energy which the printed paper receives by changing at least one item from among outputs of ultraviolet radiation lamps, the number times of light emission from the plurality of ultraviolet radiation lamps, and the space between the ultraviolet radiation lamps and the printed paper.

5. The printing device as claimed in claim 1, further comprising:

ink color detection means for determining whether the color of ink in the print drum attached to the printing device main body via the attaching/detaching means is black or not; and third control means for controlling the ultraviolet radiation means so that the radiation energy becomes larger than radiation energy which the printed paper receives in the case of using a color of ink other than black, when attachment of the print drum for ultraviolet curable ink is detected by the print drum detection means, and when attachment of a print drum for black ultraviolet curable ink is detected by the ink color detection means.

6. The printing device as claimed in claim 5, wherein the ultraviolet irradiation means is configured so as to change the radiation energy which the printed paper receives by changing at least one item of outputs of ultraviolet radiation lamps, the number times of light emission from the plurality of ultraviolet radiation lamps, and the space between the ultraviolet radiation lamps and the printed paper.

7. The printing device as claimed in claim 1, further comprising:

paper conveying means for conveying a printed paper to be irradiated with the ultraviolet radiation;

paper conveyance driving means for driving the paper conveying means; and third control means for controlling the paper conveyance driving means so that only the paper conveyance means is driven, when attachment of the print drum for non-ultraviolet curable ink is detected by the print drum detection means and when a print instruction is issued.

8. The printing device as claimed in claim 1, wherein the ultraviolet irradiation means is configured so as to be attachable and detachable to and from the printing device main body, and the printing device further comprises connection detection means for detecting whether the ultraviolet irradiation means is connected to the printing device main body, and third control means for performing the control operation of at least the first control means when a connection of the ultraviolet irradiation means to the printing device main body is detected by the connection detection means.

9. The printing device as claimed in claim 8, further comprising fourth control means for signaling a warning when a connection of the ultraviolet irradiation means to the printing device main body is detected by the connection detection means and when attachment of the print drum for non-ultraviolet curable ink is detected by the print drum detection means.

10. An ultraviolet irradiation apparatus capable of being connected to a printing device, the ultraviolet irradiation apparatus comprising:

ultraviolet irradiation means for irradiating a printed paper with ultraviolet radiation;

paper conveying means for conveying the printed paper to be irradiated with the ultraviolet radiation, a paper conveying speed of the paper conveying means increasing as a printing speed increases, and the paper conveying speed of the paper conveying means decreasing as a paper size in a paper conveyance direction decreases;

control means for operating the ultraviolet irradiation means on the basis of a signal transmitted from the printing device indicating that a print drum for ultraviolet curable ink installed with an ultraviolet curable ink has been attached, and for stopping the operation of the ultraviolet irradiation means on the basis of a signal transmitted from the printing device indicating that a print drum for non-ultraviolet curable ink installed with a non-ultraviolet curable ink has been attached;

paper conveyance driving means for driving the paper conveying device; and second control means for controlling the paper conveyance driving device so as to make a change to conveying speed of the paper conveying device in response to printing speed information and paper conveyance direction size information only when attachment of the print drum for ultraviolet curable ink is indicated by the control means such that a distance between consecutive printed papers is changed by the second control means from a first distance before the paper conveyance driving means to a second distance after the paper conveyance driving means.

11. A printing device, comprising:

an ultraviolet irradiation device configured to irradiate a printed paper with ultraviolet radiation;

an attaching/detaching device configured to selectively attach and detach to and from a printing device main body a print drum for ultraviolet curable ink, installed with an ultraviolet curable ink, and a print drum for non-ultraviolet curable ink, installed with a non-ultraviolet curable ink;

a print drum detection device configured to detect whether the print drum attached to the printing device main body via the attaching/detaching device is either the print drum for ultraviolet curable ink or the print drum for non-ultraviolet curable ink;

a first control device configured to operate the ultraviolet irradiation device when attachment of the print drum for ultraviolet curable ink is detected by the print drum detection device, and stopping the operation of the ultraviolet irradiation device when attachment of the print drum for non-ultraviolet curable ink is detected by the print drum detection device;

a paper conveying device configured to convey a printed paper to be irradiated with the ultraviolet radiation, a paper conveying speed of the paper conveying device increasing as a printing speed increases, and the paper conveying speed of the paper conveying device decreasing as a paper size in a paper conveyance direction decreases;

a paper conveyance driving device configured to drive the paper conveying device; and a second control device configured to control the paper conveyance driving device so as to make a change to conveying speed of the paper conveying device in response to printing speed information and paper conveyance direction size information only when attachment of the print drum for ultraviolet curable ink is detected by the print drum detection device such that a distance between consecutive printed papers is changed by the second control device from a first distance before the paper conveyance driving device to a second distance after the paper conveyance driving device.

12. The printing device as claimed in claim 11, further comprising:

a printing speed-setting device configured to set printing speed; and a third control device for making a change to execution of signaling a warning and/or to printing speed for ultraviolet irradiation when attachment of the print drum for ultraviolet curable ink is detected by the print drum detection device and when set printing speed which is set by the printing speed setting device exceeds the printing speed for ultraviolet irradiation which is set in advance in accordance with ultraviolet irradiation by the ultraviolet irradiation device.

13. The printing device as claimed in claim 11, further comprising a third control device configured to control the ultraviolet irradiation device so as to change radiation energy which the printed paper receives, in response to at least one type of information of paper-type information, image-type information, and fixation-degree instruction information, when attachment of the print drum for ultraviolet curable ink is detected by the print drum detection device.

14. The printing device as claimed in claim 13, wherein the ultraviolet irradiation device is configured so as to change the radiation energy which the printed paper receives by changing at least one item from among outputs of ultraviolet radiation lamps, the number times of light emission from the plurality of ultraviolet radiation lamps, and the space between the ultraviolet radiation lamps and the printed paper.

15. The printing device as claimed in claim 11, further comprising:

an ink color detection device configured to determine whether the color of ink in the print drum attached to the printing device main body via the attaching/detaching device is black or not; and a third control device configured to control the ultraviolet radiation device so that the radiation energy becomes larger than radiation energy which the printed paper receives in the case of using a color of ink other than black, when attachment of the print drum for ultraviolet curable ink is detected by the print drum detection device, and when attachment of a print drum for black ultraviolet curable ink is detected by the ink color detection device.

16. The printing device as claimed in claim 15, wherein the ultraviolet irradiation device is configured so as to change the radiation energy which the printed paper receives by changing at least one item of outputs of ultraviolet radiation lamps, the number times of light emission from the plurality of ultraviolet radiation lamps, and the space between the ultraviolet radiation lamps and the printed paper.

17. The printing device as claimed in claim 11, further comprising:

a third control device configured to control the paper conveyance driving device so that only the paper conveyance device is driven, when attachment of the print drum for non-ultraviolet curable ink is detected by the print drum detection device and when a print instruction is issued.

18. The printing device as claimed in claim 11, wherein the ultraviolet irradiation device is configured so as to be attachable and detachable to and from the printing device main body, and the printing device further comprises connection detection device for detecting whether the ultraviolet irradiation device is connected to the printing device main body, and a third control device for performing the control operation of at least the first control device when a connection of the ultraviolet irradiation device to the printing device main body is detected by the connection detection device.

19. The printing device as claimed in claim 18, further comprising a fourth control device configured to signal a warning when a connection of the ultraviolet irradiation device to the printing device main body is detected by the connection detection device and when attachment of the print drum for non-ultraviolet curable ink is detected by the print drum detection device.

20. An ultraviolet irradiation apparatus capable of being connected to a printing device, the ultraviolet irradiation apparatus comprising:

an ultraviolet irradiation device configured to irradiate a printed paper with ultraviolet radiation;

a paper conveying device configured to convey the printed paper to be irradiated with the ultraviolet radiation, a paper conveying speed of the paper conveying device increasing as a printing speed increases, and the paper conveying speed of the paper conveying device decreasing as a paper size in a paper conveyance direction decreases;

a control device configured to operate the ultraviolet irradiation device on the basis of a signal transmitted from the printing device indicating that a print drum for ultraviolet curable ink installed with an ultraviolet curable ink has been attached, and for stopping the operation of the ultraviolet irradiation device on the basis of a signal transmitted from the printing device indicating that a print drum for non-ultraviolet curable ink installed with a non-ultraviolet curable ink has been attached;

a paper conveyance driving device for driving the paper conveying device; and a second control device configured to control the paper conveyance driving device so as to make a change to conveying speed of the paper conveying device in response to printing speed information and paper conveyance direction size information only when attachment of the print drum for ultraviolet curable ink is indicated by the control device such that a distance between consecutive printed papers is changed by the second control device from a first distance before the paper conveyance driving device to a second distance after the paper conveyance driving device.

21. The printing device as claimed in claim 11, further comprising:

a display configured to display whether the print drum attached to the printing device main body via the attaching/detaching device is either the print drum for ultraviolet curable ink or the print drum for non-ultraviolet curable ink based on a result of the print drum detection device.

22. The ultraviolet irradiation apparatus as claimed in claim 20, wherein the second control device reduces the distance between consecutive printed papers by reducing the second distance to be less than the first distance.

* * * * *